US009211712B2

(12) United States Patent
Johnson

(10) Patent No.: US 9,211,712 B2
(45) Date of Patent: Dec. 15, 2015

(54) INJECTION MOLDED INK JET MODULES

(71) Applicant: Palo Alto Research Center Incorporated, Palo Alto, CA (US)

(72) Inventor: David M. Johnson, San Francisco, CA (US)

(73) Assignee: PALO ALTO RESEARCH CENTER INCORPORATED, Palo Alto, CA (US)

( * ) Notice: Subject to any disclaimer, the term of this patent is extended or adjusted under 35 U.S.C. 154(b) by 0 days.

(21) Appl. No.: 14/142,317

(22) Filed: Dec. 27, 2013

(65) Prior Publication Data

US 2015/0183216 A1 Jul. 2, 2015

(51) Int. Cl.

| | |
|---|---|
| ***B41J 2/14*** | (2006.01) |
| ***B41J 2/16*** | (2006.01) |
| *B41J 2/015* | (2006.01) |
| *B41J 2/135* | (2006.01) |

(52) U.S. Cl.
CPC ..... *B41J 2/1433* (2013.01)

(58) Field of Classification Search
CPC ..... B41J 2/155; B41J 2/162–2/1648; B41J 2/1752; B41J 2202/20
USPC ..... 347/20, 44, 47, 49
See application file for complete search history.

(56) References Cited

U.S. PATENT DOCUMENTS

| | | | | |
|---|---|---|---|---|
| 5,148,194 | A * | 9/1992 | Asai et al. | 347/49 |
| 5,469,199 | A * | 11/1995 | Allen et al. | 347/42 |
| 6,068,367 | A * | 5/2000 | Fabbri | 347/49 |
| 6,428,142 | B1 | 8/2002 | Silverbrook et al. | |
| 6,467,874 | B1 * | 10/2002 | Williams et al. | 347/42 |
| 6,471,335 | B1 * | 10/2002 | Gelbart | 347/49 |
| 6,663,223 | B2 * | 12/2003 | Horii et al. | 347/42 |
| 6,843,551 | B2 | 1/2005 | Silverbrook | |
| 6,860,581 | B2 | 3/2005 | Silverbrook et al. | |
| 7,175,256 | B2 * | 2/2007 | Silverbrook | 347/40 |
| 7,984,978 | B2 * | 7/2011 | Conta et al. | 347/85 |
| 2009/0122118 | A1 * | 5/2009 | Bibl et al. | 347/68 |

OTHER PUBLICATIONS

Proto Labs, November_2012_Design_Tips_Crush_Ribs, Nov. 2012, downloaded from http://www.protolabs.com/resources/injection-molding-design-tips/united-states/2012-11/default.htm on Jan. 23, 2015, pp. 1-3.*

* cited by examiner

*Primary Examiner* — Jannelle M Lebron
*Assistant Examiner* — Jeremy Bishop
(74) *Attorney, Agent, or Firm* — Hollingsworth Davis, LLC

(57) ABSTRACT

A print head includes an aperture plate and a plurality of duplicate, injection molded, jet modules that are coupled to the aperture plate. Each of the jet modules includes a plurality of jets and corresponding ink supply cavity that seals against the aperture plate and provides ink to the jets. Each jet module further includes a registration member and an edge alignment feature. The registration member holds the jet module in place relative to a corresponding registration member of the aperture plate. The edge alignment feature overlaps a corresponding alignment feature on a neighboring one of the jet modules in a z-direction and minimizes misalignment between the jet module and the neighboring jet module.

20 Claims, 7 Drawing Sheets

INJECTION MOLDED INK JET MODULES

BACKGROUND

Ink jet printers may range from inexpensive models designed for home use to large printers designed for industrial applications. The latter may include large format printers and/or those used for large production runs. Many of these printers utilize phase change inks, which, compared to aqueous inks, may be more durable, provide brighter colors, and less dependent on substrate properties for consistent results. Generally, such printers are produced in smaller quantities that those designed for general use, and as such may require flexibility in the print formats provided (e.g., dots per inch, number of jets, print head size, etc.). As such, it is desirable to provide such flexibility in print formats while still keeping costs as low as possible.

SUMMARY

The present disclosure is related to ink jet printers. In one embodiment, a print head includes an aperture plate that defines a print-parallel surface and a z-direction normal thereto. A plurality of duplicate, injection molded, jet modules are coupled to the aperture plate. Each of the jet modules includes a plurality of jets and corresponding ink supply cavity that seals against the aperture plate and provides ink to the jets. Each jet module further includes a registration member that holds the jet module in place relative to a corresponding registration member of the aperture plate. Each jet module further includes an edge alignment feature that overlaps a corresponding alignment feature on a neighboring one of the jet modules in a z-direction. The edge alignment feature minimizes misalignment between the jet module and the neighboring jet module.

In another embodiment, a method involves injection molding a plurality of jet modules. The jet modules comprise matching edge alignment features that align the jet modules side-by-side with one another, and registration members that align the jet modules to an aperture plate that defines a print-parallel surface of a print head and a z-direction normal thereto. The method further involves attaching a first of the jet modules to the aperture plate such that its registration member positions the first of the jet modules on the aperture plate. A second of the jet modules is attached to the aperture plate such that its registration member positions the second of the jet modules on the aperture plate, and further such that its edge alignment feature overlaps and aligns with a corresponding edge alignment feature of the first of the jet modules.

In another embodiment, a print head includes an aperture plate that defines a print-parallel surface and a z-direction normal thereto. A plurality of duplicate, injection molded, jet modules are coupled to the aperture plate. Each of the jet modules includes a plurality of jets and corresponding ink supply cavity that seals against the aperture plate and provides ink to the jets. Each jet module further includes a registration means for holds the jet module in place relative to a corresponding registration member of the aperture plate. Each jet module further includes an edge alignment means for minimizing misalignment between the jet module and a neighboring jet module. The edge alignment means overlaps a corresponding edge alignment means on a neighboring one of the jet modules in a z-direction.

These and other features and aspects of various embodiments may be understood in view of the following detailed discussion and accompanying drawings.

BRIEF DESCRIPTION OF THE DRAWINGS

In the following diagrams, the same reference numbers may be used to identify similar/same/analogous components in multiple figures. The drawings are not necessarily to scale.

DETAILED DESCRIPTION

The present disclosure is generally related to print heads that use liquid ink jets. These inks may include hot melt inks (also referred to herein as "phase change inks") that are solid at room temperature and melted during use. Print heads may also include aqueous inks that are liquid at room temperature. In either case, the ink is sent via fluid passages to the print head, which may include a large number of jets arranged in a particular pattern. The number, size, and other parameters of an ink jet printer may vary depending on design goals such as print speed, cost, reliability, print quality, etc.

Embodiments described herein have features for assembling ink jet print heads with modular, injection molded jet parts. This allows creating a large jet stacks from smaller modular components. The unique three-dimensional properties that injection molding provides compared to two-dimensional manufacturing techniques allows for greater stacking density (and less waterfront) while maintaining close alignment of the jets with each other.

While injection molding offers incremental cost advantages to a layer-by-layer, stacked construction method for forming large-area jet stack assemblies, there are large capital tooling costs associated with injection molding. Tooling costs are related to the size of the part and the machining time required to produce the features. Therefore, by making smaller parts from a single mold, capital costs may be reduced, and injected ink jet stacks become a viable alternative.

While it is sometimes desirable to produce as few parts as possible in an assembly, there may be times when capital costs outweigh the advantages of using larger and fewer injection molded parts. For example, using smaller injection molded modular parts may significantly reduce costs for small production runs. It is also beneficial to have jet stack designs that are flexible in their application to any print head.

For example, a series of jet stack designs could be produced using a single type of inkjet module to form print heads with widths ranging from 3 inches to 9 inches wide. A print head can be produced with any width and height that is an integer multiple of the width and height of the jet modules.

Figure 1:
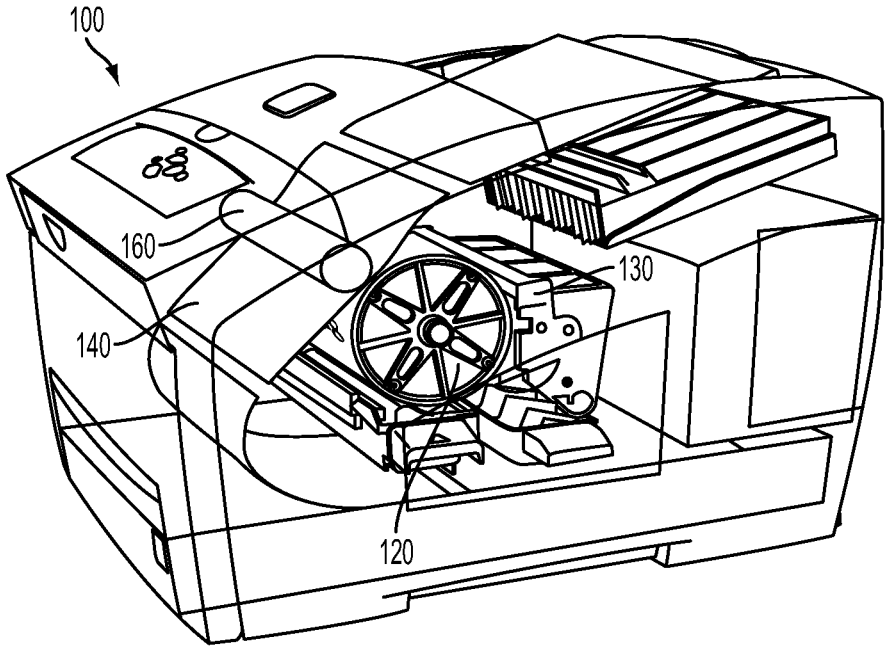
FIG. 1 is a perspective view of an inkjet printer according to an example embodiment.
Figure 2:
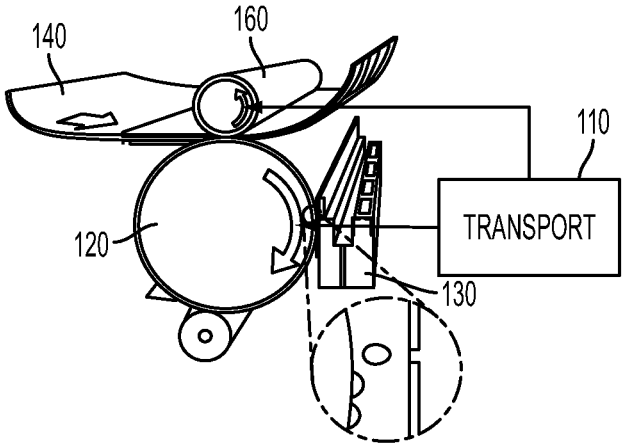
FIG. 2 is a perspective view showing internal details an ink jet printer according to an example embodiment.

In FIGS. 1 and 2, perspective views provide internal details of portions of an ink jet printer 100 that incorporates ink jet stack features as discussed herein. The printer 100 includes a transport mechanism 110 that is configured to move the drum 120 relative to the print head 130 and to move the paper 140 relative to the drum 120. The print head 130 may extend fully or partially along the length of the drum 120 and includes a number of ink jets. As the drum 120 is rotated by the transport mechanism 110, ink jets of the print head 130 deposit droplets of ink though ink jet apertures onto the drum 120 in the desired pattern. As the paper 140 travels around the drum 120, the pattern of ink on the drum 120 is transferred to the paper 140 through a pressure nip 160.

Figure 3:
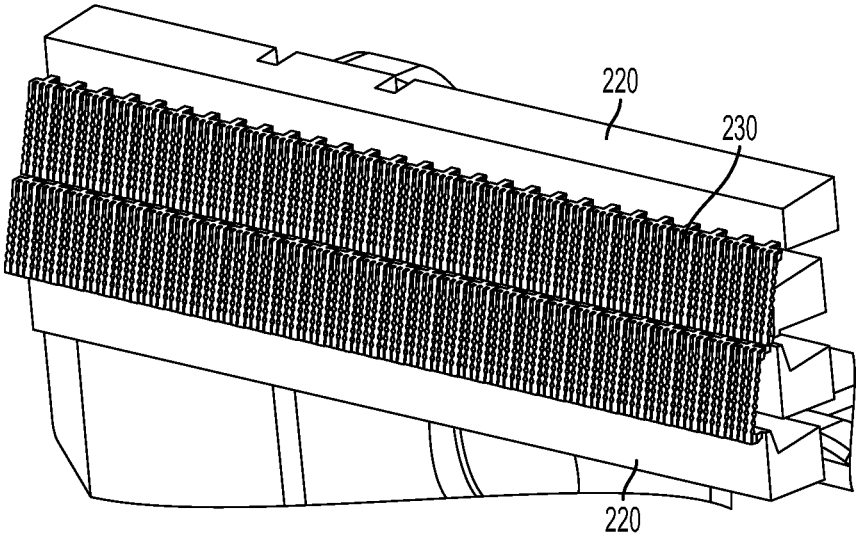
FIGS. 3 and 4 are perspective views showing details of a print head according to an example embodiment.
Figure 4:
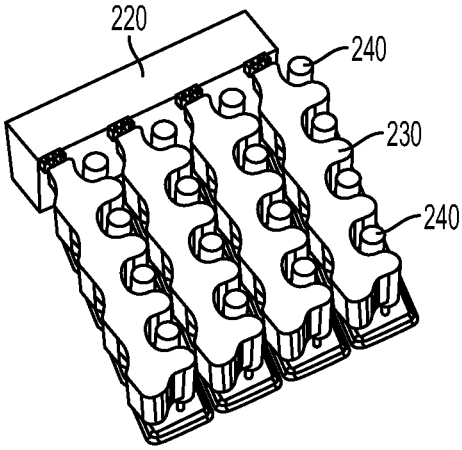

In FIGS. 3 and 4, perspective views show details of a print head according to an example embodiment. The path of ink, contained initially in a reservoir, flows through a port into a main manifold 220 of the print head. As best seen in FIG. 4, in some cases, there are multiple manifolds 220 which are overlaid, e.g., one manifold 220 per ink color. Each of these manifolds 220 connects to interwoven finger manifolds 230. The ink passes through the finger manifolds 230 and then into the ink jets 240. The manifold and ink jet geometry illustrated in FIG. 4 is repeated in the direction of the arrow to achieve a desired print head length, e.g. the full width of the drum.

Figure 5:
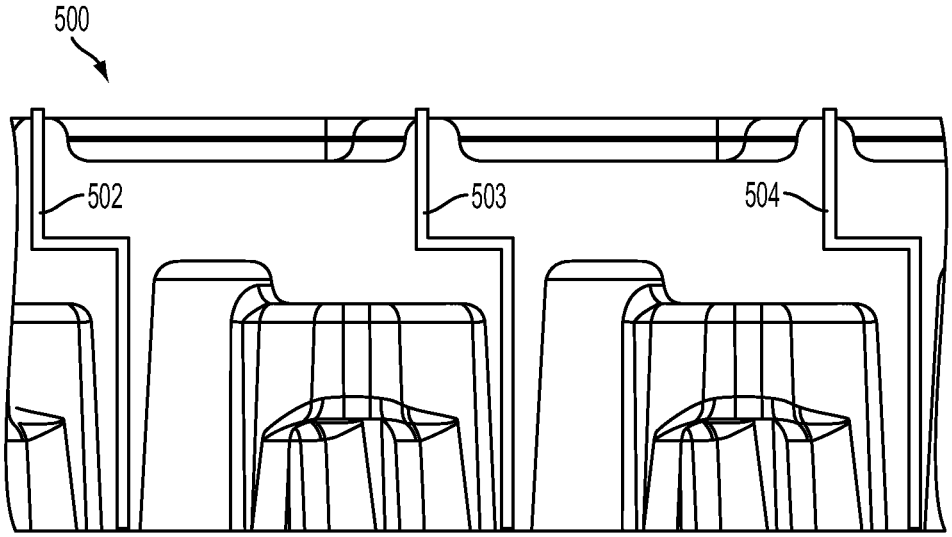
FIG. 5 is a side view showing details of a jet module according to an example embodiment.

In some examples discussed in this disclosure, the print head may use piezoelectric transducers (PZTs) for ink droplet ejection. However, the modular ink jet stack embodiments described herein may be used for devices that employ other methods of ink droplet ejection. In FIG. 5, a diagram shows an example of an injection molded ink jet stack 500 according to an example embodiment. A jet stack of this type is able to achieve higher density by allowing layers to overlap in three-dimensional space. As see by lines 502-504 in the example jet stack 500, the division between each jet includes horizontal surfaces. While this type of stacking is relatively easy to create using injection molding, it n may be infeasible or require extraordinary steps to implement using two-dimensional fabrication techniques (e.g., laser cutting, etching).

Figure 6:
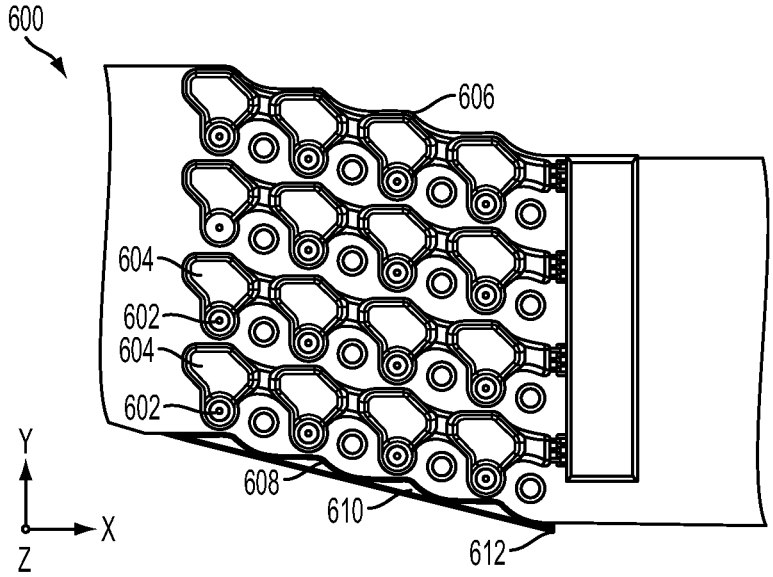
FIG. 6 is a top view showing details of a jet module according to an example embodiment.

A more detailed view of a jet module 600 according to an example embodiment is shown in the plan view of FIG. 6. The jet module 600 includes a plurality of jets 602, e.g., individual orifices that selectably eject ink in response to activation of heat or piezoelectric elements. The jets 602 are fluidly coupled to corresponding ink supply cavities 604 that provide ink to the jets 602. The ink supply cavities 604 (and other fluid carrying regions such as supply manifolds) seal against a back plate (not shown) on the back side of the jet module 600.

The jet module 600 is designed to be joined together with duplicates thereof, e.g., modules made from the same mold as module 600. In order to ensure alignment therebetween, the module 600 includes edge alignment features that overlap a corresponding alignment feature of a neighboring one of the jet modules. Among those features are sawtooth edges 606, 608. The sawtooth edge 608 includes a ledge 610 that overlaps a corresponding edge 606 in the z-direction. The module 600 may be generally planar, therefore using a common convention, the z-direction (indicated by the coordinate system in the figure) is normal to the plane of the module 600, which also by convention is indicated as an xy-plane. Other alignment means may be used between adjacent modules, including convoluted edges with overlapping ledges. The convoluted edges may have any combination of shapes, including rectangular sections, circular sections, curved sections, polyline sections, etc.

The z-direction overlap between sawtooth edge 606 and ledge 610 facilitates positively aligning adjacent jet modules 600 during assembly. The overlap may also provide strength to the jet stack after assembly. For example, friction between the overlapping regions assists in preventing relative movement between adjacent modules in response to shock and vibration. This strength can be increased by including bonding material in the overlap between the sawtooth edge 606 and the ledge 610.

Another alignment feature shown in FIG. 6 is protrusion 612. This protrusion 612 interfaces with a notch (not seen in this view) of adjacent jet modules 600. The protrusion 612 and notch inhibits relative rotation between the jet module 600 and neighboring jet module about a z-aligned axis. This inhibition of rotation is also facilitated by the use of registration members that hold the jet module in place on an aperture plate, which are shown and described below.

Figure 7:
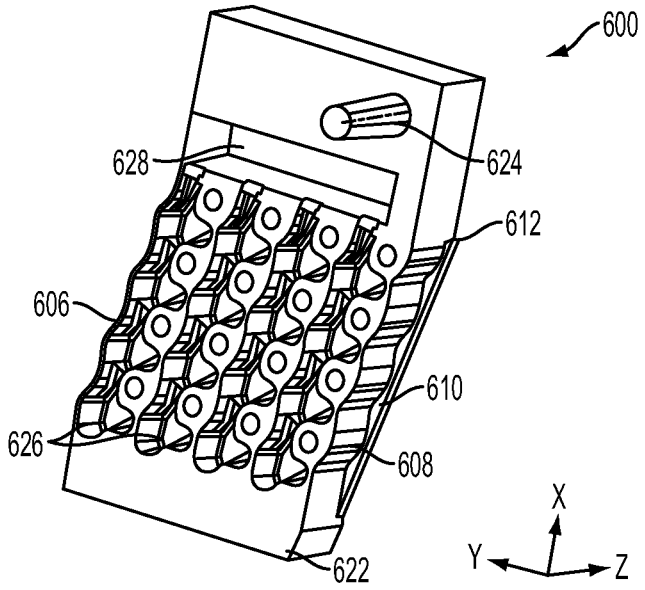
FIG. 7 is a back, perspective view showing details of a jet module according to an example embodiment.

In reference now to FIG. 7, an isometric view shows the back side of the jet module 600 of FIG. 6. It can be more clearly seen in this view how the ledge 610 interfaces with sawtooth edge 608, and will trap sawtooth edge 606 of a neighboring module. Also seen in this view is mounting surface 622 and registration member 624 that facilitate mounting the jet module 600 to an aperture plate. A bonding agent (e.g., adhesive) may be applied to the mounting surface 622 before assembly to the aperture plate. The bonding material mechanically attaches the jet module 600, and seals ink flow cavities 626 at the back of the jet module 600. The ink flow cavities 626 join a feed manifold region 628 to the jet 602 and supply cavities 604 shown in FIG. 6.

Figure 8:
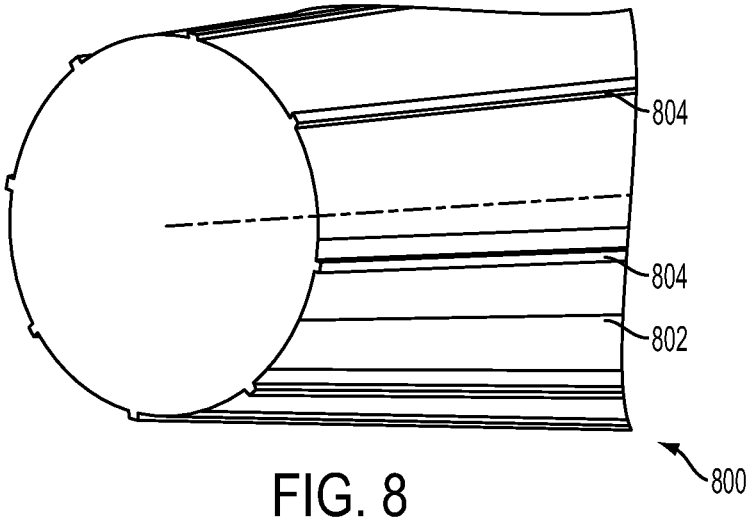
FIG. 8 is a perspective view of a registration member according to an example embodiment.

In FIG. 8, a perspective view shows the registration member 800 close up. Generally, the registration member 800 in this example is configured as a pin 802 with crush ribs 804. The crush ribs 804 deform during assembly to a corresponding registration feature (e.g., hole in the aperture plate, see FIG. 10). This deformation assures positive contact around the perimeter of the registration member 800 even if there is a slight misalignment, e.g., due to non-circularity of the registration member 800 with the corresponding registration feature. It will be understood that other registrations means may be used (e.g., tabs, snaps, grooves) and need not be limited to the example pins/holes. Further, the holes or similar feature may be included on the jet module 600, and the pin or similar feature may be included on the aperture plate.

The location and size of the pin 802 are determined based on the optimal molding parameters of the jet module. In order to compensate for any variations in diameter of the aperture plate, crush ribs 804 ensure the part is centered. The crush ribs 804 may follow the taper of the locating pin. The thickness of the crush ribs equal to the largest tolerance stack up between the hole diameter and pin diameter (Dhole,max−Dpin,min) as determined by the manufacturing process parameters.

Figure 10:
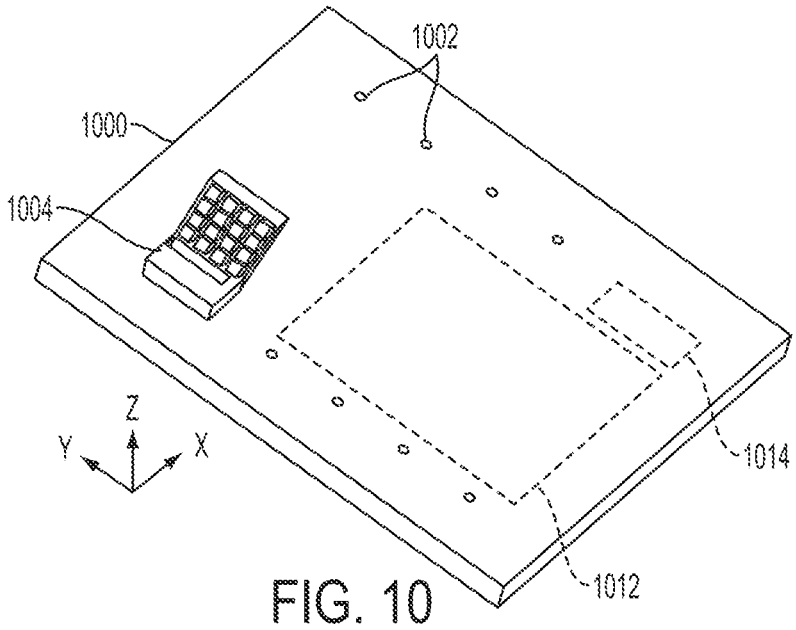
FIGS. 10 and 11 is are perspective views of a jet modules being attached to an aperture plate according to an example embodiment.
Figure 11:
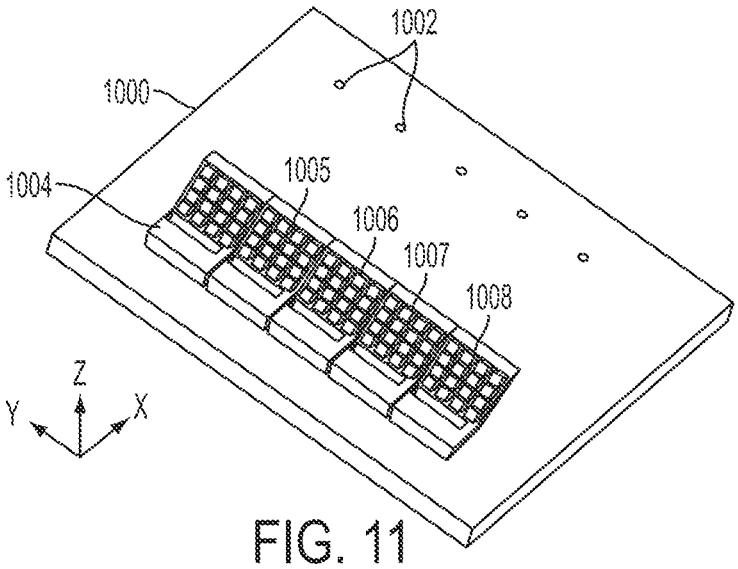

In reference now to FIGS. 10 and 11, a perspective view illustrates a stack-up of jet modules according to an example embodiment. An aperture plate 1000 includes a plurality of registration holes 1002. The holes 1002 can be predrilled, or made by some other manufacturing process (for example, laser cutting). The aperture plate 1000 can be made as big or as small as needed for the individual print head. Generally the aperture plate 1000 will include fluid routing features that are not shown here for clarity in the drawing. Other components may also attach to the aperture plate 1000, such as piezoelectric elements, heater components, circuitry, etc.

A first jet module 1004 is shown being placed in FIG. 10, and additional modules 1005-1008 are added in FIG. 11. Another registration/alignment member (not shown) may be provided to ensure correct rotational alignment of the first jet module 1004 to the aperture plate 1000. Thereafter, additional modules 1005-1008 will align to the first module 1004 via the edge alignment features. The jet modules 1004-1008 can be installed by a robotic arm. For example, a robotic system can remove parts from the mold, facilitate any inspection or finishing processes, and assemble the modules 1004-1008 in place onto the aperture plate 1000. This process may also be performed in whole or in part by hand.

In order to bond the jet modules 1004-1008 to the aperture plate 1000, and adhesive (e.g. film) may be applied to the top surface of the aperture plate 1000. In addition or in the alternative, as shown in FIG. 7 an adhesive layer may be applied to the mounting surface 622 of the injection molded jet module 600. Other operations, such as heat treating or application of pressure, may be performed to strengthen the bond. After all the jet modules 1004-1008 are positioned on the aperture plate 1000, the PZT 1014 elements and flex circuits 1012 can be bonded to the backside (e.g., a side of the plate opposite the jet modules) in the same manner they would have if the jet stack had been a single monolithic part.

In the illustrated arrangement, one registration hole 1002 is used per jet module 1004-1008, each module having one corresponding registration feature (e.g., pin 802 shown in FIG. 8). In other arrangements, more than one registration means may be used per jet module 1004-1008. In such a case, the relative alignment between neighboring jet modules (as well as between module and plate) may be entirely determined by the plate-to-module registration means. If only a single registration means is used, and such registration means allows for rotation about the z-axis (such as the illustrated holes 1002 and corresponding pins 802), then the module-to-module interfacing features may be used to ensure rotational alignment of the modules 1004-1008, as will be described in greater detail below.

Figure 12:
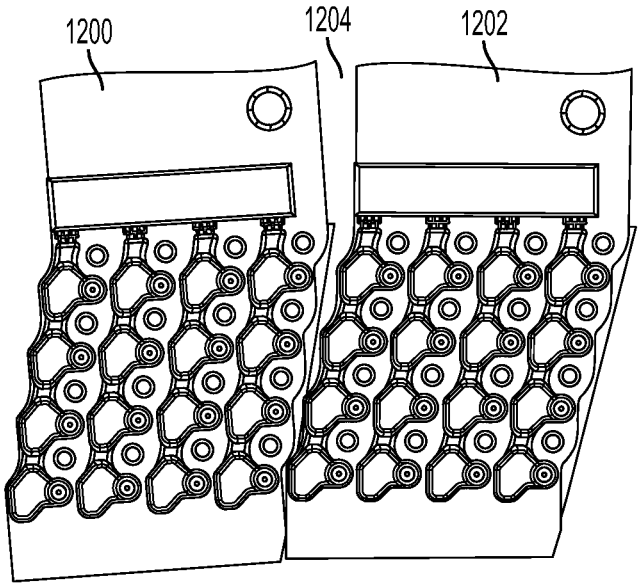
FIGS. 12 and 13 are plan views showing alignment features according to an example embodiment.
Figure 13:
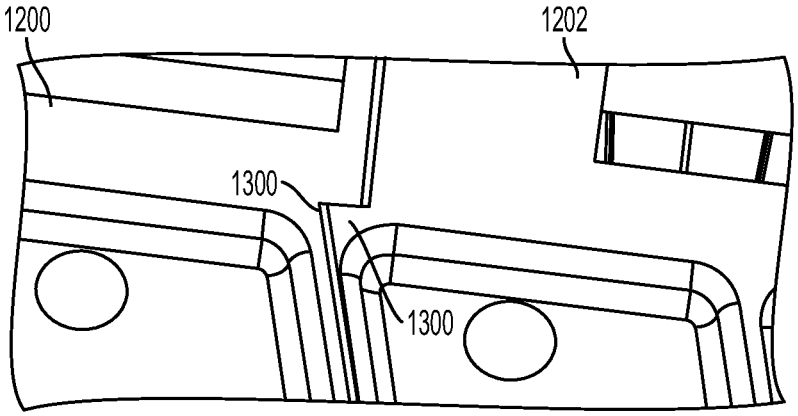

In reference now to FIGS. 12 and 13, a plan view of adjacent jet modules 1200, 1202 illustrates angular alignment features according to an example embodiment. Molded parts tolerances are largely dependent on the processing conditions and the material consistency, but generally will be no more than the shrinkage of the material from liquid state to solid state. To illustrate this, an exaggerated version of manufacturing variation is shown in FIG. 12.

For the case of low shrink polysulfone materials such as Radel® R-5800 (Solvay Plastics), the shrinkage is 0.70%. The example illustrated in FIG. 12, the jet modules 1200, 1202 are about 2.8 mm in width, so it is conservative to assume a +0/−20 micron tolerance on the overall width. The gap between parts will lead to some small angular misalignment between the two parts, as represented by exaggerated gap 1204. Assuming the alignment holes are placed in exactly the correct spot, this will lead to a 16 micron deviation in circularity between the aperture and the injection molded part due to angular misalignment per stackup. Given a 230 micron hole on the injection molded part and a 40 micron aperture diameter, the maximum number of parts that could be combined in any row is 5 without the edges of the aperture and the molded part interfering.

To prevent excessive rotation, perpendicular alignment features are included as shown in FIG. 13. These alignment features include a protrusion 1300 that interfaces with a corresponding notch 1302 that matches the protrusion 1300. The protrusion 1300 and notch 1302 inhibit relative rotation between the jet module 1200 and the neighboring jet module 1202 about an axis aligned in the z-direction (e.g., an axis normal to the drawing plane). This allows stacking additional components in a line without excessive deviation from ideal alignment. A perpendicular dimension (left to right in the drawing) of the protrusion 1300 and notch 1302 should be greater than the maximum spacing between the modules 1200, 1202.

Figure 14:
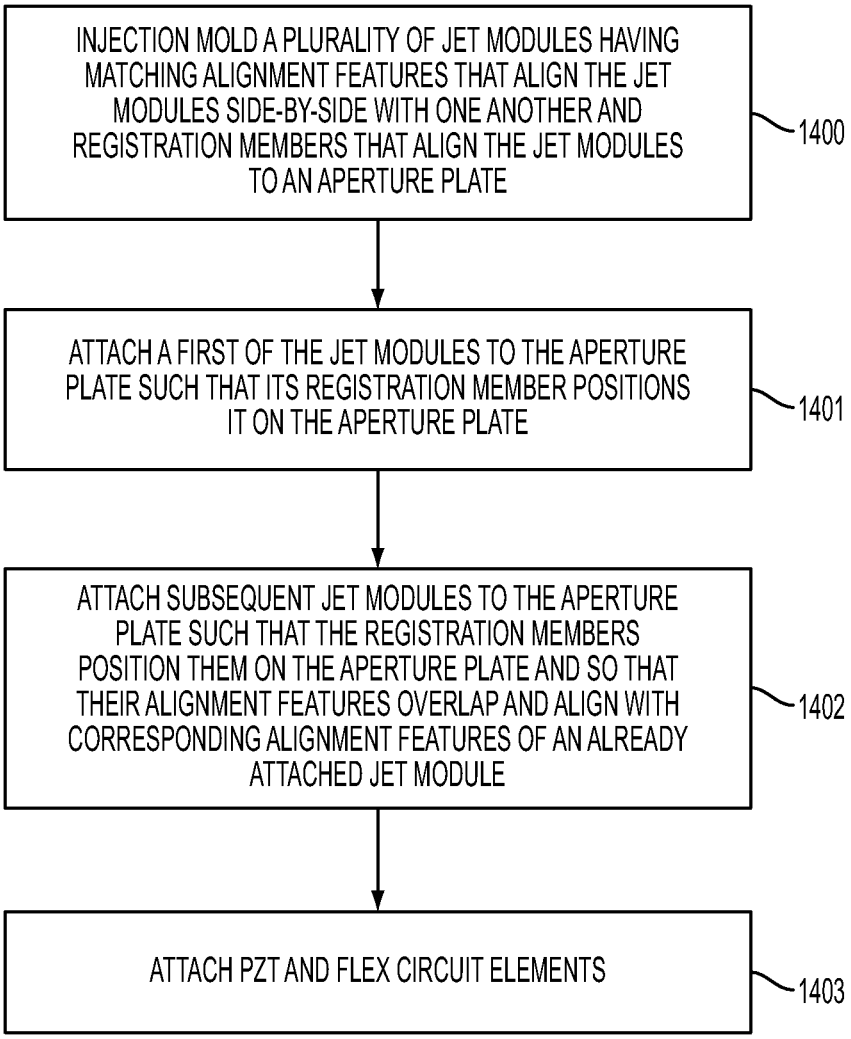
FIG. 14 is a flowchart showing a method according to an example embodiment.

In reference now to FIG. 14, a flowchart illustrates a method according to an example embodiment. The method involves injection molding 1400 a plurality of jet modules having matching alignment features that align the jet modules side-by-side with one another and registration members that align the jet modules to an aperture plate. The aperture plate defines a print-parallel surface of a print head and a z-direction normal thereto.

A first of the jet modules is attached 1401 to the aperture plate such that its registration member positions it on the aperture plate. Subsequent jet modules (at least one more) are attached 1402 to the aperture plate such that the registration member position them on the aperture plate and so that their alignment features overlap and align with corresponding alignment features of an already attached jet module. The method may optionally further involve attaching 1403 PZT and flex circuit elements to the print head, e.g., to the aperture plate.

The various embodiments described above may be implemented using circuitry and/or software modules that interact to provide particular results. One of skill in the computing arts can readily implement such described functionality, either at a modular level or as a whole, using knowledge generally known in the art. For example, the flowcharts illustrated herein may be used to create computer-readable instructions/code for execution by a processor. Such instructions may be stored on a non-transitory computer-readable medium and transferred to the processor for execution as is known in the art. The structures and procedures shown above are only a representative example of embodiments that can be used to facilitate managing caching in data storage devices as described above.

The foregoing description of the example embodiments has been presented for the purposes of illustration and description. It is not intended to be exhaustive or to limit the inventive concepts to the precise form disclosed. Many modifications and variations are possible in light of the above teaching. Any or all features of the disclosed embodiments can be applied individually or in any combination are not meant to be limiting, but purely illustrative. It is intended that the scope be limited not with this detailed description, but rather determined by the claims appended hereto.

What is claimed is:

1. A print head comprising:

an aperture plate that defines a print-parallel surface and a z-direction normal thereto; and a plurality of duplicate, injection molded, jet modules coupled to the aperture plate, each of the jet modules comprising:

a plurality of jets and corresponding ink supply cavity that seals against the aperture plate and provides ink to the jets;

a registration member that holds the jet module in place relative to a corresponding registration member of the aperture plate; and an edge alignment feature that overlaps a corresponding alignment feature on a neighboring one of the jet modules in a z-direction, the edge alignment feature minimizing misalignment therebetween.

2. The print head of claim 1, wherein at least one of the edge alignment feature and the corresponding alignment feature comprises a sawtooth edge.

3. The print head of claim 2, wherein one of the edge alignment feature and the corresponding alignment feature comprise a ledge that overlaps the other of the edge alignment feature and the corresponding alignment feature in the z-direction.

4. The print head of claim 1, wherein the registration member comprises a pin with crush ribs, and the corresponding registration member comprises a hole.

5. The print head of claim 1, further comprising an adhesive that bonds the jet modules to the aperture plate.

6. The print head of claim 1, wherein the edge alignment feature further comprises a protrusion and the corresponding alignment feature comprises a notch that matches the protrusion, the protrusion and the notch inhibiting relative rotation between the jet module and the neighboring jet module about an axis aligned in the z-direction.

7. The print head of claim 6, wherein the protrusion extends from an edge of the jet module by a distance that is greater than a maximum allowable spacing between the jet module and the neighboring jet module.

8. The print head of claim 1, wherein friction between the overlapping alignment features assists in preventing relative movement between neighboring jet modules.

9. The print head of claim 1, further comprising a flex circuit and piezoelectric transducers on a side of the aperture plate opposite the jet modules.

10. A method comprising:

injection molding a plurality of jet modules, the jet modules comprising:

matching edge alignment features that align the jet modules side-by-side with one another; and registration members that align the jet modules to an aperture plate that defines a print-parallel surface of a print head and a z-direction normal thereto;

attaching a first of the jet modules to the aperture plate such that its registration member positions the first of the jet modules on the aperture plate; and attaching a second of the jet modules to the aperture plate such that its registration member positions the second of the jet modules on the aperture plate, and further such that its edge alignment feature overlaps and aligns with a corresponding edge alignment feature of the first of the jet modules.

11. The method of claim 10, wherein the plurality of jet modules are duplicates of one another.

12. The method of claim 10, wherein at least one of the edge alignment features and corresponding alignment features comprises a sawtooth edge.

13. The method of claim 12, wherein one of the edge alignment features and the corresponding alignment features comprise a ledge that overlaps the other of the edge alignment features and the corresponding alignment features in the z-direction.

14. The method of claim 10, wherein the registration members comprise pins with crush ribs, and corresponding registration members on the aperture plate comprise holes.

15. The method of claim 10, further comprising applying an adhesive that bonds the first and second of the jet modules to the aperture plate.

16. The method of claim 10, wherein the edge alignment feature and the corresponding edge alignment feature comprise a protrusion and a notch that matches the protrusion, the protrusion and the notch inhibiting relative rotation between the first and second of the jet modules about an axis aligned in the z-direction.

17. The method of claim 16, wherein the protrusion extends from an edge of the first jet module by a distance that is greater than a maximum allowable spacing between the first jet module and the second jet module.

18. The method of claim 10, further comprising:

defining a first width and a first height of the print head that is an integer multiple of a second width and a second height of the jet modules; and selecting a number of the plurality of jet modules to correspond to the first width and the first height of the print head.

19. The method of claim 10, further comprising attaching a flex circuit and piezoelectric transducers on a side of the aperture plate opposite the jet modules.

20. A print head comprising:

an aperture plate that defines a print-parallel surface and a z-direction normal thereto; and a plurality of duplicate, injection molded, jet modules coupled to the aperture plate, each of the jet modules comprising:

a plurality of jets and corresponding ink supply cavity that seals against the aperture plate and provides ink to the jets;

a registration means for holding the jet module in place relative to a corresponding registration member of the aperture plate; and an edge alignment means for minimizing misalignment between the jet module and a neighboring jet module, the edge alignment means overlapping a corresponding edge alignment means on a neighboring one of the jet modules in a z-direction.

* * * * *